United States Patent [19]

Schmidt et al.

[11] 4,290,352

[45] Sep. 22, 1981

[54] REFUSE BIN LID UNIT

[75] Inventors: Lewis W. Schmidt, Rio Vista; Darryl G. Bettencourt, Lodi; Charles F. Dietz, Rio Vista; George E. Marshall, Jr., Elk Grove, all of Calif.

[73] Assignee: Blackwelders, Rio Vista, Calif.

[21] Appl. No.: 149,032

[22] Filed: May 12, 1980

[51] Int. Cl.[3] ..... B30B 1/32; B30B 15/04

[52] U.S. Cl. ..... 100/100; 100/233; 100/255; 220/1 T; 220/333; 292/218; 292/336.3; 414/406; 414/525 R

[58] Field of Search ..... 100/100, 233, 255, 229 A; 220/1 T, 333; 414/406, 407, 408, 410, 424, 525 R; 292/214, 217, 218, 336.3, 256.5

[56] References Cited

U.S. PATENT DOCUMENTS

| | | | |
|---|---|---|---|
| 778,446 | 12/1904 | Clark | 100/255 X |
| 1,030,648 | 6/1912 | Cramer | 100/255 |
| 1,229,628 | 6/1917 | Lowrie | 100/255 |
| 2,941,690 | 6/1960 | Keys | 220/333 |
| 3,625,140 | 12/1971 | Glanz | 100/255 X |
| 3,680,478 | 8/1972 | Beachner | 100/233 |
| 3,709,389 | 1/1973 | Steltz | 100/233 X |
| 3,739,715 | 6/1973 | Ambrose | 100/100 |
| 3,955,492 | 5/1976 | Topolay | 100/255 X |
| 3,961,573 | 6/1976 | Schmidt | 100/100 |
| 4,070,962 | 1/1978 | Peterson | 100/233 |
| 4,103,608 | 8/1978 | Chenot | 100/233 |
| 4,152,979 | 5/1979 | Schmidt | 100/233 |

FOREIGN PATENT DOCUMENTS

| | | | |
|---|---|---|---|
| 11750 | of 1915 | United Kingdom | 220/333 |

*Primary Examiner*—Billy J. Wilhite
*Attorney, Agent, or Firm*—Roger B. Webster

[57] ABSTRACT

A lid unit for a portable refuse bin adapted to be engaged and inverted, by the lift mechanism of a refuse truck, to discharge a load of refuse from the bin and into the receiving body of the truck; the lid unit being hinged to the bin and normally but releasably latched in closed position, and a hinged loading lid is included in the lid unit and normally but releasably latched in closed position; the loading lid—when unlatched—being manually swingable, relative to the remainder of the lid unit, to open position to permit manual deposit of refuse in the bin, and the entire lid unit gravitationally swinging to open position when unlatched and upon such inversion of the bin, whereupon the load of refuse dumps from the bin and into the receiving body of the truck; the loading lid remaining in latched, closed position during said inversion of the bin.

2 Claims, 7 Drawing Figures

FIG-7
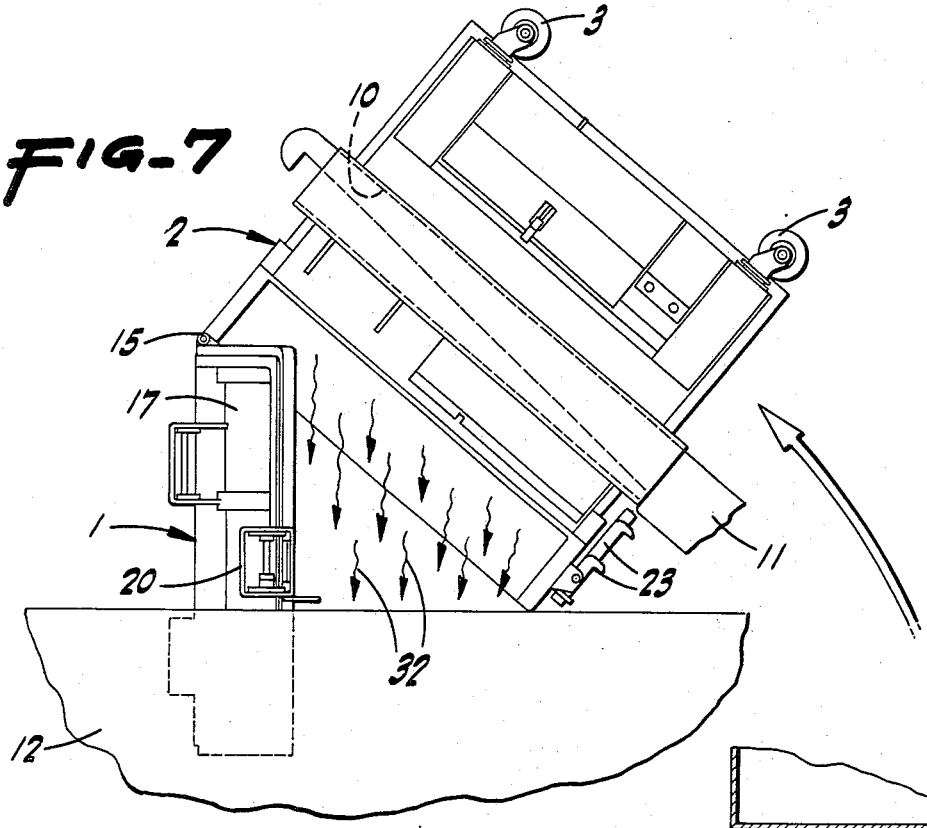
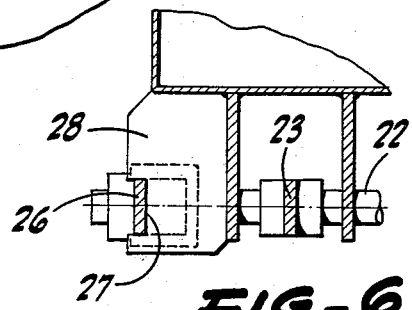
FIG-6
FIG-4
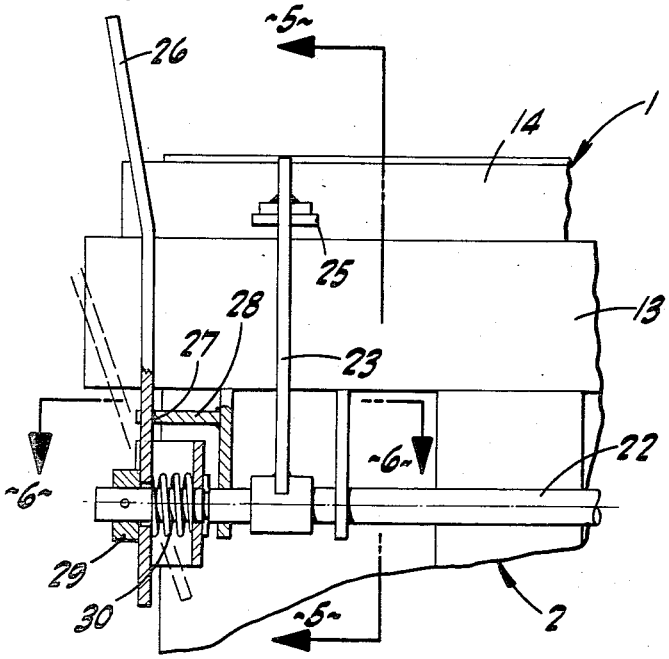
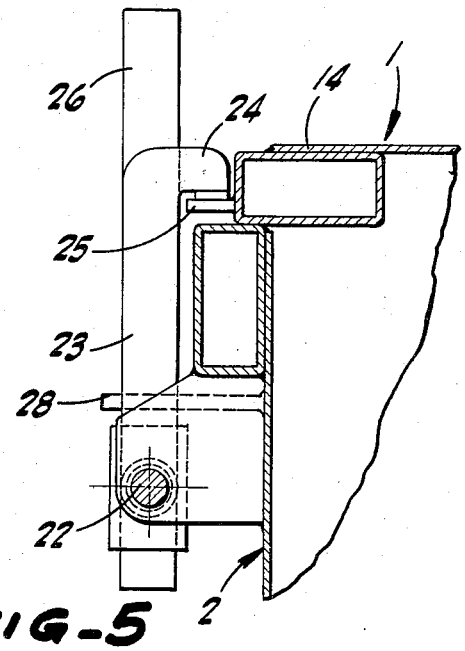
FIG-5

REFUSE BIN LID UNIT

BACKGROUND OF THE INVENTION

1. Field of the Invention

In portable, invert-to-dump, refuse bins—especially those of compactor type including a power-actuated, refuse-compacting blade movable in the bin—it is desirable, for safety, that the included swingable lid unit be normally latched in a closed position while at the same time providing for access—without unlatching the lid unit and by way of an included loading lid—into the bin for manual deposit of refuse therein. The present invention was conceived in a successful effort to provide a refuse bin lid unit which meets such criteria.

2. The Prior Art

Applicants are not aware of any issued United States patent, or other prior art, disclosing the particular structure and function of the refuse bin lid unit shown and claimed herein; U.S. Pat. No. 4,152,979 being representative of the prior art known to applicants.

SUMMARY OF THE INVENTION

The present invention provides, as an important object, a novel lid unit for a portable, invert-to-dump refuse bin; the lid unit being especially designed, but not limited, for use on a refuse bin of compactor type including a power-actuated, refuse-compacting blade movable in the bin.

The present invention provides, as another important object, a lid unit for a portable refuse bin adapted to be engaged and inverted, by the lift mechanism of a refuse truck, to discharge a load of refuse from the bin and into the receiving body of the truck; the lid unit being hinged to the bin and normally but releasably latched in closed position, and a hinged loading lid is included in the lid unit and normally but releasably latched in closed position; the loading lid—when unlatched—being manually swingable, relative to the remainder of the lid unit, to open position to permit manual deposit of refuse in the bin, and the entire lid unit gravitationally swinging to open position when unlatched and upon such inversion of the bin, whereupon the load of refuse dumps from the bin and into the receiving body of the truck; the loading lid remaining in latched, closed position during said inversion of the bin.

The present invention provides, as a further object, a refuse bin lid unit which is designed for ease and economy of manufacture.

The present invention provides, as a still further object, a practical, reliable, and durable refuse bin lid unit, and one which is exceedingly effective for the purpose for which it is designed.

BRIEF DESCRIPTION OF THE DRAWINGS

FIG. 4 is an enlarged, fragmentary, elevation showing, partly in section, the manually releasable locking device for the lid unit latching mechanism.

FIG. 5 is a transverse vertical section taken substantially on line 5—5 of FIG. 4.

FIG. 6 is a sectional plan taken substantially on line 6—6 of FIG. 4.

FIG. 7 is a front end elevation of the refuse bin as inverted by the lift mechanism of a refuse truck, and with the lid unit as gravitated to open position, whereby refuse dumps from the bin into the receiving body of the truck.

DESCRIPTION OF THE PREFERRED EMBODIMENT

Figure 1:
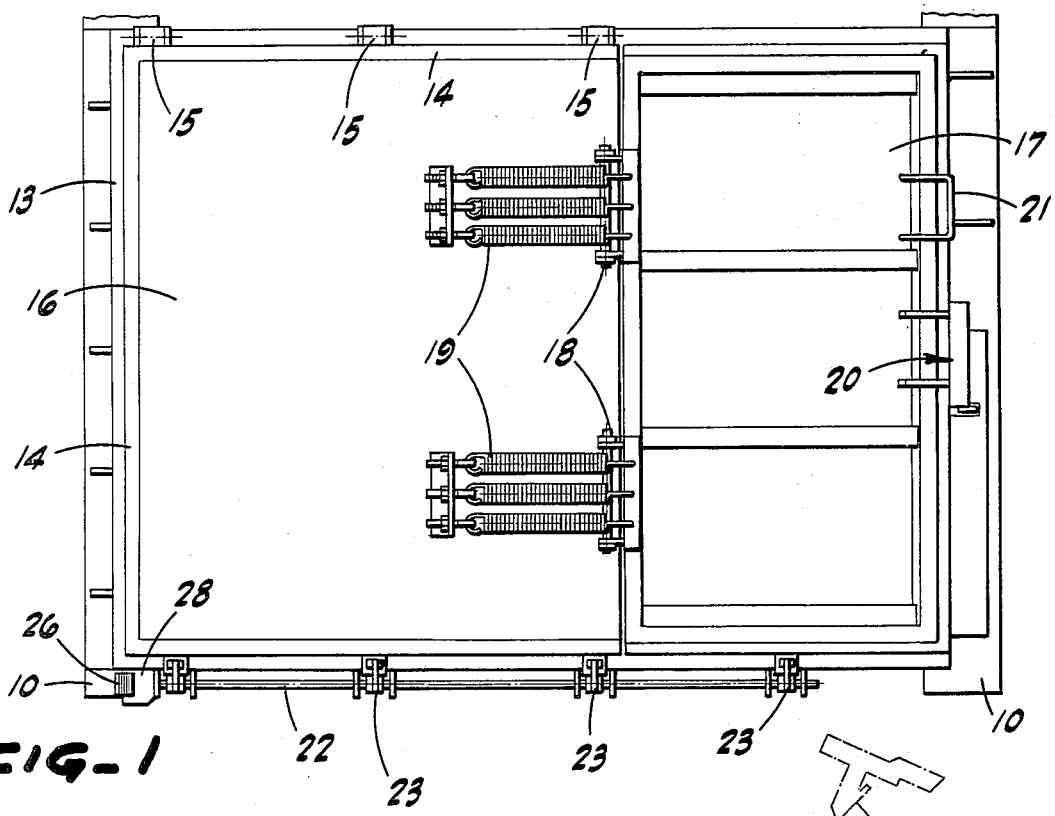
FIG. 1 is a plan view of the lid unit as mounted on a refuse bin.
Figure 2:
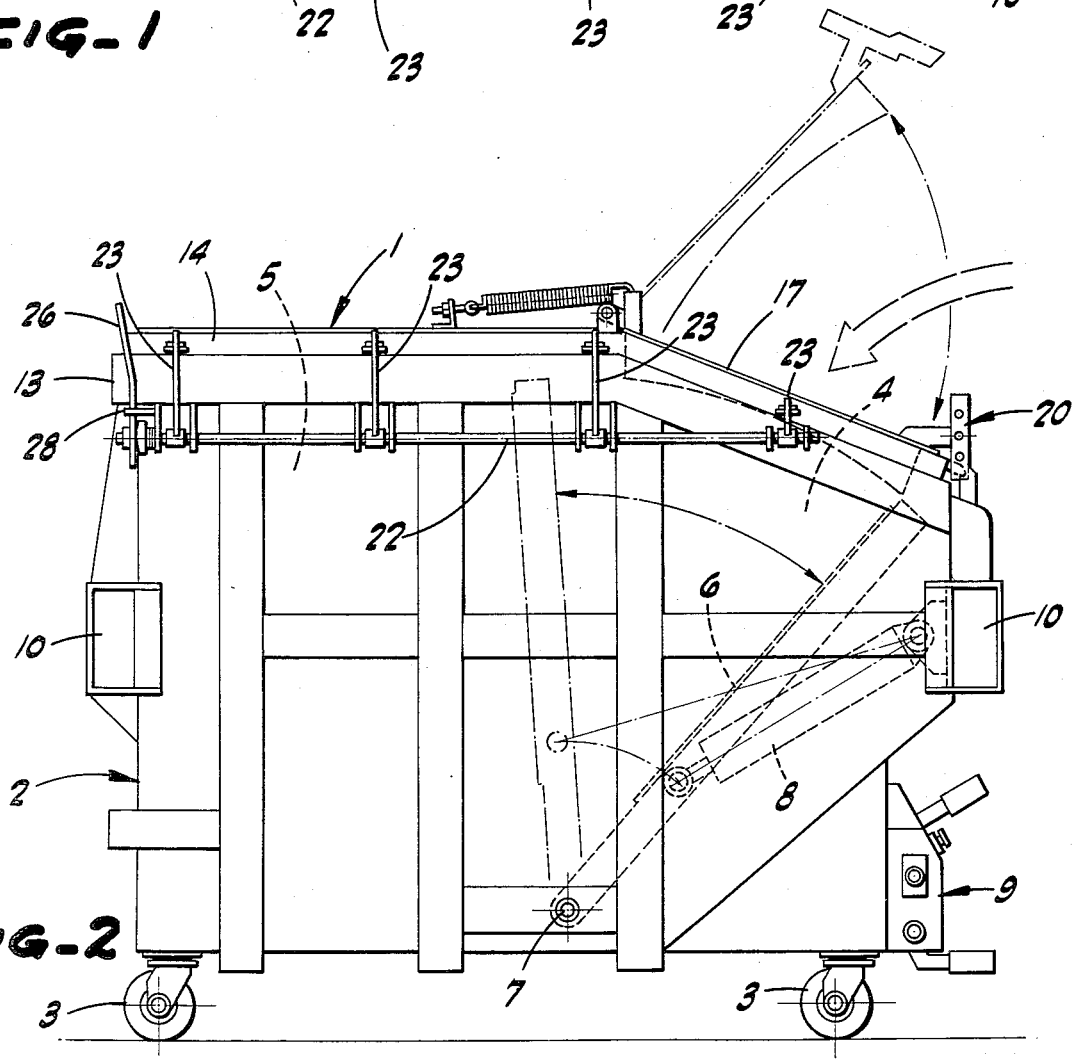
FIG. 2 is a side elevation of the same; the loading lid being shown in closed position in full lines, and in open position in broken lines.

Referring now more particularly to the drawings and to the characters of reference marked thereon, the lid unit, indicated generally at 1, normally provides the closure for a bin, indicated generally at 2; the bin—floor-supported by caster wheels 3—being rectangular in plan, of compactor type, and internally defines a refuse-receiving chamber 4 in the forward portion of the bin, and a refuse-packing chamber 5 in the rearward portion of the bin.

A power-actuated packing blade 6 is pivoted, as at 7, adjacent the bottom of the blade and is adapted to be swung, from an initially forwardly inclined position, rearwardly in chamber 4 whereby to thrust pre-deposited refuse from said chamber 4 into chamber 5 and to pack such refuse in the latter chamber. The packing blade 6 is actuated by a power cylinder assembly 8 connected between the blade 6 and the front of the bin. Such power cylinder assembly is responsive to a power control unit 9 outside on the bin at the front thereof.

At both the front and rear and intermediate the top and bottom thereof, the bin 2 includes a horizontal, transverse, full width, tubular, open-ended pocket 10; such pockets being adapted for the reception of the lift forks of the lift mechanism of a refuse truck; one such fork being indicated at 11 in FIG. 7, and such mechanism (not otherwise shown) being operative to lift and invert the bin 2 over the receiving body 12 whereby the lid unit 1 gravitationally swings open and the refuse dumps from the bin into such truck body—all as more particularly described hereinafter.

The lid unit is constructed and mounted as follows:

At the top, the bin 2 is provided with a fixed, heavyduty border frame 13; the side elevational configuration of the bin being such that the border frame 13 inclines forwardly and downwardly over the refuse-receiving chamber 4.

Figure 3:
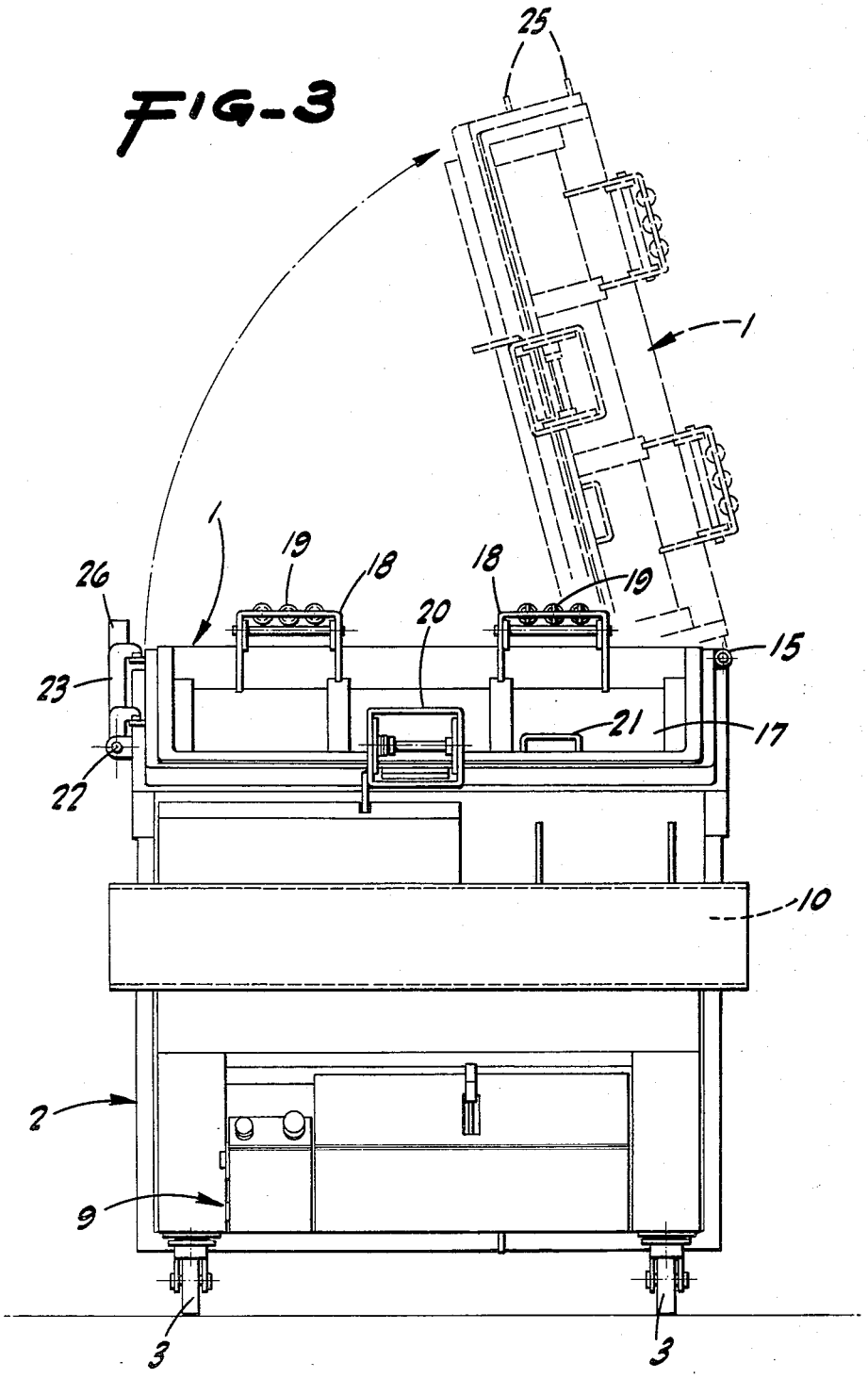
FIG. 3 is a front elevation of the bin-mounted lid unit; such lid unit being shown in closed position in full lines, and—for illustration only—in open position in broken lines. Actually, in use, the bin unit assumes an open position only when the bin is inverted to dump the refuse therefrom—as hereinafter described.

A matching swing frame 14 normally rests, in mating relation, on the border frame 13; such swing frame 14 being hinged at one side, as at 15, to the border frame 13 for lateral swinging away from the bin and to a bin-opening position. See FIGS. 3 and 7.

A rear lid section 16 is permanently secured to the rear portion of the swing frame 14 in normally covering relation to the refuse packing chamber 5, and a front lid section 17 embraces the front portion of the swing frame 14 in normally covering relation to the refuse-receiving chamber 4.

The front lid section 17—which may be termed the loading lid section—is hinged, as at 18, at its rear edge to the front edge of the rear lid section 16; such front lid section 17 being counterbalanced by spring arrays 19 associated with the hinges 18.

The front or loading lid section 17 is normally held in down or closed position by a manually releasable, self-reengaging latch 20 connected between the front edge of said lid section 17 and an adjacent portion of the swing frame 14; the latch 20 being disposed substantially centrally between the sides of lid section 17, and the latter being fitted with an upstanding lifting handle 21.

To deposit refuse in the refuse-receiving chamber 4, a person manually releases the latch 20, and then—by handle 21—lifts the front lid section 17 to open position. After deposit of refuse, the lid section 17 is returned to closed position and latch 20 self-reengages.

With the front lid section 17 in normally closed, latched position, and with the entire lid unit 1 also normally latched in closed position as hereinafter described, the packing blade 6 is operated, by power cylinder assembly 8, to thrust pre-deposited refuse from chamber 4 into the packing chamber 5.

The latching mechanism for the entire lid unit 1 comprises a horizontal shaft 22 journaled in connection with, and extending along, one side of the bin 2; such shaft 22, at spaced points in the length thereof, having upstanding radial latch arms 23 fixed thereon. At the upper end, each arm 23 is formed with an inwardly projecting, downwardly facing hook 24 which normally engages downwardly against a fixed pad 25 on the adjacent side of the swing frame 14. A radial hand lever 26 upstands from one end portion of the shaft 22; manual swinging of hand lever 26, in a laterally outward and downward direction, rotating shaft 22 and releasing the hooks 24 from pads 25 whereby the swing frame 14, and consequently the entire lid unit 1, is unlatched preparatory to opening thereof.

The hand lever 26—through which shaft 22 passes—is releasably maintained in upstanding position by snap-engagement of said lever 26 in the notch 27 of a catch ear 28 fixed relative to the bin. The hand lever 26, which is rockable on shaft 22, is engaged, in the zone of such shaft 22, between a collar 29 fixed thereon and a confined compression spring 30 which normally binds the lever 26 against such collar yet permits lever 26 to be swung out of notch 27 and then be swung to rotate shaft 26 and release hooks 24.

When the packing chamber 5 is filled with compacted refuse, and the bin 2 is to be dumped, the swing frame 14 is first unlatched in the manner above described. Nextly, the forks 11 of the lift mechanism of a refuse truck are inserted in the receiving pockets 10, whereupon—by said lift mechanism—the bin 2 is swung upward and inverted over the refuse-receiving body of such truck. Upon such inversion of the bin, the entire lid unit 1 gravitationally swings, about hinges 15, to a laterally open position, and the refuse, as at 31, falls from the bin into said receiving body of the truck.

Upon return of the bin 2 to its normal upright position, the entire lid unit gravitationally closes, whereupon the latch mechanism for the swing frame 14 is re-engaged; this being accomplished by the hand lever 26 being swung upward and re-seated in notch 27, whereupon hooks 24 re-engage pads 25.

From the foregoing description, it will be readily seen that there has been produced such refuse bin lid unit as substantially fulfills the objects of the invention as set forth herein.

While this specification sets forth in detail the present and preferred construction of the refuse bin lid unit, still in practice such deviations from such detail may be resorted to as do not form a departure from the spirit of the invention as defined by the appended claims.

We claim:

1. A lid unit, for a portable, invert-to-dump refuse bin, having a front, rear, and sides and defining therein a refuse-packing chamber in the rear portion and a refuse-receiving chamber in the front portion, and power means in the bin operative to thrust refuse from the receiving chamber into the packing chamber; the lid unit comprising a swing frame normally resting in substantially mating relation in closed position on the bin, a rear lid section on the swing frame overlying the refuse packing chamber, a front lid section on the swing frame overlying the refuse-receiving chamber, said lid sections normally enclosing the bin, the rear lid section being fixed on the swing frame, means transversely hinging the front lid section at the rear for swinging from a closed to an open position, means between the swing frame and the front lid section releasably latching the latter in closed position, means longitudinally hinging the swing frame at one side to the bin for swinging of the entire lid unit from a closed position to an open position, and means between the swing frame at the other side and the bin releasably latching the entire lid unit in said closed position.

2. A lid unit, for a portable, invert-to-dump refuse bin, having a front, rear, and sides and defining therein a refuse-packing chamber in the rear portion and a refuse-receiving chamber in the front portion, and power means in the bin operative to thrust refuse from the receiving chamber into the packing chamber; the lid unit comprising a swing frame normally resting in substantially mating relation in closed position on the bin, a rear lid section on the swing frame overlying the refuse packing chamber, a front lid section on the swing frame overlying the refuse-receiving chamber, said lid sections normally enclosing the bin, the rear lid section being fixed on the swing frame, means transversely hinging the front lid section at the rear for swinging from a closed to an open position, means between the swing frame and the front lid section releasably latching the latter in closed position, means longitudinally hinging the swing frame at one side to the bin for swinging of the entire lid unit from a closed position to an open position, and means between the swing frame at the other side and the bin releasably latching the entire lid unit in said closed position; said lid unit latching means comprising a longitudinal shaft journaled exteriorly on the bin and extending along said other side thereof, a plurality of radial latch arms secured in spaced relation to and upstanding from the shaft, a downwardly facing hook on the upper end of each latch arm normally catch-engaging a fixed member on the swing frame, a radial hand lever on the shaft adapted to be swung to rotate the shaft and move the radial latch arms in a direction to disengage said hooks, and means between the bin and the radial hand lever yieldably maintaining the latter in a position with the hooks catch-engaged.

* * * * *